United States Patent [19]

Zoleski et al.

[11] 4,375,418

[45] Mar. 1, 1983

[54] LUBRICATING OIL COMPOSITION

[75] Inventors: Benjamin H. Zoleski, Beacon; Rodney L. Sung; William P. Cullen, both of Fishkill, all of N.Y.

[73] Assignee: Texaco Inc., White Plains, N.Y.

[21] Appl. No.: 315,825

[22] Filed: Oct. 28, 1981

[51] Int. Cl.[3] ..... C10M 1/48

[52] U.S. Cl. ..... 252/33.4; 252/32.7 E; 252/32.7 HC; 252/51.5 A; 252/51.5 R; 252/46.7; 252/49.7; 252/42.7

[58] Field of Search ..... 252/33.4, 51.5 A, 51.5 R, 252/42.7, 46.7, 49.7, 327 E

[56] References Cited

U.S. PATENT DOCUMENTS

| | | | |
|---|---|---|---|
| 4,049,564 | 9/1977 | Ryer et al. | 252/51.5 A |
| 4,153,566 | 8/1979 | Ryer et al. | 252/51.5 A |
| 4,253,978 | 3/1981 | Gemmill et al. | 252/51.5 A |
| 4,266,944 | 5/1981 | Sung | 44/63 |

*Primary Examiner*—Jacqueline V. Howard

[57] ABSTRACT

A lubricating oil composition designed for use in medium and high speed marine diesel engine crankcases which has a Total Base Number from about 5 to 40 and contains a mineral lubricating oil, an overbased calcium sulfonate, an overbased sulfurized calcium phenate, a zinc dihydrocarbyl dithiophosphate, an alkenylsuccinimide, and a friction reducing amount of at least one acyl glycine oxazoline derivative.

7 Claims, No Drawings

LUBRICATING OIL COMPOSITION

BACKGROUND OF THE INVENTION

1. Field of the Invention

This invention is concerned with a novel crankcase lubricating composition having reduced friction properties in medium and high speed marine diesel engines.

Crankcase lubricating oil compositions for medium and high speed diesel engines must possess a number of essential characteristics in order to be operable and to maintain their effectiveness for a satisfactory period of time. In general, such compositions must possess alkalinity expressed as Total Base Number ranging from about 5 to 40 TBN, anti-water properties, dispersancy, good viscosity index properties, oxidation inhibition and demulsifying properties.

The need to improve efficiency in the use of oil has spurred intensive efforts to discover a crankcase lubricating oil composition which can materially reduce the friction losses which take place within the engine itself. A reduction in engine friction losses translates directly into significant fuel savings. Numerous means have been employed to reduce the friction inside an internal combustion engine. These range from the use of a lower viscosity crankcase lubricating oil or a mixture of mineral and synthetic lubricating oils as well as to the incorporation of friction-reducing additives, such as graphite, molybdenum compounds and other chemical additives. However, there are limits to the extent to which the viscosity of a lubricating oil can be reduced for the purpose of reducing friction. Generally, a lubricating oil having too light a viscosity will fail to prevent metal-to-metal contact during high load operating conditions with the result that unacceptable wear will occur in the engine. With respect to chemical antifriction additives, significant research efforts are ongoing to find effective and economic anti-friction additives which exhibit stability over an extended service life and under a wide range of operating conditions.

DESCRIPTION OF PRIOR DISCLOSURES

Coassigned U.S. Pat. No. 4,266,944 issued May 12, 1981 to R. L. Sung describes and claims the instant acyl glycine oxazolines and their use as detergents in gasoline. Heretofore, experience has shown that ineffective gasoline detergents may be effective in oils and vice versa so that the performance of these compounds in oils was totally unexpected.

U.S. Pat. No. 3,116,252 issued Dec. 31, 1963 to H. S. Beretvas describes a rust inhibiting composition for lubricants consisting of a mixture of an acyl sarcosine, a 1,2—disubstituted imidazoline and an alkylene oxide rosin amine reaction product.

The disclosures of the U.S. patents noted above are incorporated herein by reference.

As will be seen hereinafter, neither of these disclose in any manner Applicants' invention.

A copending application, Ser. No. 315,571, filed on Oct. 27, 1981, discloses a cylinder lubricating oil composition for a slow speed marine diesel engine.

A copending application, Ser. No. 315,570, filed on Oct. 27, 1981, discloses a marine crankcase lubricant for a large slow speed marine diesel engine.

SUMMARY OF THE INVENTION

The crankcase lubricating oil composition of this invention comprises a lubricating oil, an overbased calcium sulfonate an overbased calcium phenolate, a zinc dihydrocarbyl dithiophosphate, an alkenylsuccinimide, and a minor friction reducing amount of at least one acyl glycine oxazoline derivative represented by the formula:

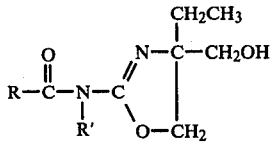

where R is lauryl, $C_{11}H_{23}$, oleyl or stearyl; and R' is hydrogen or lower alkyl. Preferably R and R' taken together contain from 13 to 21 carbon atoms.

Preferably, both the R and R' radicals are straight chain, however they also can be branched and may be substituted with one or more non-interfering substituents such as cyano, trifluoromethyl, nitro or alkoxy.

A sufficient amount of overbased calcium sulfonate and/or overbased calcium phenolate is used to impart to the lubricating oil composition a Total Base Number (TBN) of about 5 to about 40.

The novel method of the invention involves operating a medium to high speed marine diesel engine by supplying the above-described lubricating oil composition to the crankcase lubrication system of said engine.

SPECIFIC EMBODIMENTS OF THE INVENTION

In a more specific embodiment of the invention, the crankcase lubricating composition of the invention will comprise at least 80 weight percent of a mineral lubricating oil, from about 0.1 to 5 weight percent of an overbased calcium sulfonate sufficient to impart a Total Base Number to the lubricating oil composition ranging between about 5 and 40, from about 0.1 to 2.5 weight percent of an anti-wear, antioxidant zinc dihydrocarbyl dithiophosphate represented by the formula:

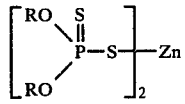

in which R is a hydrocarbyl radical or a hydroxy substituted hydrocarbyl radical having from about 4 to 12 carbon atoms, from about 0.5 to 10 weight percent of a nitrogen-containing succinimide dispersant represented by the formula:

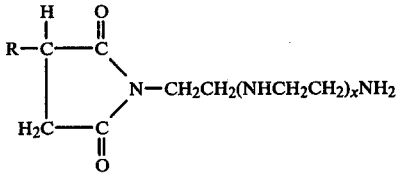

wherein R is alkenyl of from 50 to 200 carbons and x is an integer of from 0 to 10 and/or its zinc salt.

Also essential to the crankcase lubricating oil composition of the invention is an overbased calcium sulfonate having a Total Base Number ranging from 300 to 450 on an active material or neat basis. This component is employed in the finished cylinder lubricating oil at a concentration ranging from about 0.1 to 5 weight percent based on the weight of the lubricating oil composition and sufficient to provide a lubricating oil having a Total Base Number from about 5 to 40. A preferred overbased calcium sulfonate has a TBN ranging from about 350 to 425, a preferred concentration of the sulfonate in the lubricating oil is from about 0.5 to 2.0 weight percent and a preferred TBN for the lubricating oil composition is from 10 to 30. Total Base Number (TBN) is a measure of alkalinity determined according to the test procedure outlined in ASTM D-664.

Overbased calcium sulfonates can be derived from sulfonic acids or particularly from petroleum sulfonic acids or alkylated benzene sulfonic acids. Useful sulfonic acids from which the overbased calcium sulfonates are prepared can have from about 12 to 200 carbon atoms per molecule. Examples of specific sulfonic acids include mahogany sulfonic acid, petrolatum sulfonic acids, aliphatic sulfonic acids and cycloaliphatic sulfonic acids. Particularly useful alkylated benzene sulfonic acids include polybutylbenzene sulfonic acid, polypropylbenzene sulfonic acid and copolymer propyl 1-butylbenzene sulfonic acids having molecular weights ranging from about 400 to about 900.

The overbased calcium sulfonates are produced by neutralizing the sulfonic acid with a calcium based to form a calcium sulfonate salt and then overbasing the calcium sulfonate with calcium carbonate generally by passing carbon dioxide through a mixture of the neutral calcium sulfonate, mineral oil, lime and water. Methods for preparing overbased calcium sulfonates are disclosed in U.S. Pat. No. 3,779,920 and U.S. Pat. No. 4,131,551 and the disclosures in these references are incorporated herein by reference. In a preferred concentration, the overbased calcium sulfonate will provide from about 0.15 to 0.25 weight percent of calcium to the finished lubricating oil composition of the invention.

The essential zinc dialkyl dithiophosphate component of the lubricating oil is represented by the formula:

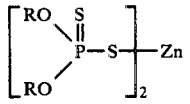

in which R is a hydrocarbyl radical or a hydroxy-substituted hydrocarbyl radical having from 4 to 12 carbon atoms. The preferred zinc dithiophosphates are those in which R represent an alkyl radical having from 4 to 8 carbon atoms. Examples of suitable compounds include zinc isobutyl 2-ethyl-hexyl dithiophosphate, zinc di(2-ethylhexyl) dithiophosphate, zinc isoamyl 2-ethylhexyl dithiophosphate, zinc di(phenoxyethyl)dithiophosphate and zinc di(2,4-diethylphenoxyethyl)dithiophosphate. In general, these compounds are employed in the oil composition in a concentration ranging from about 0.1 to 1.0 weight percent with a preferred concentration ranging from about 0.5 to 1.5 percent. In general, the zinc dithiophosphate component is employed in a concentration necessary to provide from about 0.05 to 0.20 weight percent phosphorus to the finished oil composition. These compounds can be prepared from the reaction of a suitable alcohol or mixture of alcohols with phosphorus pentasulfide. They are illustrated in U.S. Pat. Nos. 2,344,395, 3,293,181 and 3,732,167 which are incorporated herein by reference.

The essential nitrogen-containing succinimide dispersant is represented by the formula:

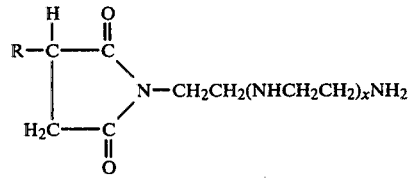

wherein R is alkenyl of from 50 to 200 carbons and x is an integer of from 0 to 10. Particularly suitable examples are where R is polyisobutylene of a molecular weight of about 1000 to 1500 and x is 3 or 4 and mixtures thereof.

The nitrogen-containing dispersants are disclosed in U.S. Pat. Nos. 3,131,150, 3,272,746 and U.S. Pat. No. 3,172,892. These citations are incorporated herein by reference.

The dispersant is normally employed in the lubricating oil composition of the invention in a concentration ranging from about 0.5 to 10 weight percent based on the weight of the lubricating oil composition. A preferred concentration for a succinimide dispersant is from about 2 to 5 weight percent.

Unless otherwise noted, the concentrations of the additive components of the lubricating oil composition of the invention are given on an active material or a neat basis based on the weight of the finished lubricating oil composition. It will be appreciated that in some instances convenience dictates the employment of oil solutions of the additives.

One preferred supplementary detergent-dispersant, a ethoxylated inorganic phosphorus acid free, steam hydrolyzed, polybutene-$P_2S_5$ reaction product is further described in U.S. Pat. Nos. 3,272,744 and 3,087,956. This supplementary detergent appears to cooperate with the subject sulfurized calcium alkylphenolate to enhance detergency and thermal stability and resistance to undesired oxidative decomposition. The ethoxylated product is present in the finished compositions of the invention in amounts between about 0.3 and 10 wt. % (oil free basis), preferably between about 0.8 and 4 wt. %, and in any case in sufficient amount to give a phosphorus content in the finished (dilute) compositions of between about 0.03 and 0.15 wt. %, preferably between about 0.01 and 0.08 wt. %.

Specific examples of the ethoxylated derivative of the inorganic phosphorus acid free, steam hydrolyzed polybutene-$P_2S_5$ reaction product are ethoxylated steam hydrolyzed polyisobutene (1100 m.w.)-$P_2S_5$ reaction product, ethoxylated, steam hydrolyzed polyisobutene (2000 m.w.)-$P_2S_5$ reaction product where the ethylene oxide component and the reaction product component are present in a mole ratio of 1:1.

Another detergent dispersant used in the present composition is an overbased sulfurized calcium phenate of the type disclosed in U.S. Pat. No. 3,969,235 which is incorporated herein by reference. This material is incorporated in the oil in an amount ranging from 0.1 and 7.00 weight percent. In general this material is prepared by (1) reacting at a temperature between 200° and 425° F. alkylphenol with a first addition of calcium alkoxyalkoxide to form a calcium alkylphenolate containing first reaction mixture utilizing between about 45 and 90 wt. % of the stoichiometric amount required to convert the alkylphenol to calcium alkylphenolate, (2) contacting the calcium alkylphenolate first reaction mixture with sulfur at a temperature between about 440° and 460° F. in the presence of between about 13 and 20 wt. % of a hydrocarbon lubricating oil based on step 2 second reaction mixture, and (3) contacting the second reaction mixture with a second addition of calcium alkoxyalkoxide at a temperature between about 350° and 425° F., said first and second addition totaling between about 100 and 120% of the stoichiometric amount of calcium alkoxyalkoxide to form said calcium alkylphenolate, said steps 1 and 3 being advantageously conducted while blowing their respective reaction mixtures with inert gas, step 2 being conducted while sequentially blowing step 2 reaction mixture with inert gas, carbon dioxide and inert gas.

Generally, however, any overbased sulfurized calcium phenate having a TBN in the range of 50 to 250 can be used whether prepared as a calcium reagent method or a lime procedure.

The composition can also contain minor amounts of an antifoam agent such as a dialkyl silicone.

In general, the friction reducing compounds of the invention are synthesized as described in U.S. Pat. No. 4,266,944 by reacting a 2-amino-2-(lower)alkyl-1,3-propanediol with an N-acyl sarcosine in an inert solvent, preferably xylene, refluxing the reaction mixture for about 8 hours to remove by azeotroping the xylene and the water of reaction; filtering and stripping the filtrate under vacuum to isolate the product.

The reaction proceeds as follows:

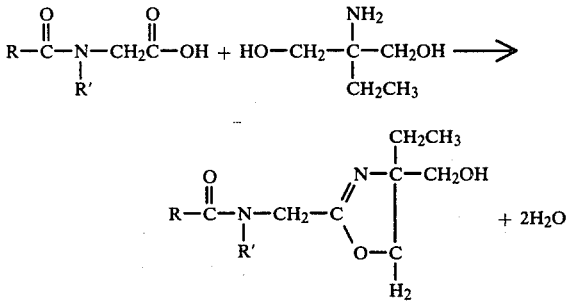

where R and R′ are as above.

N-acyl sarcosines suitable as reactants include lauroyl sarcosine, cocoyl sarcosine, oleoyl sarcosine, stearoyl sarcosine and other fatty sarcosines containing from 8 to 22 carbon atoms. The preferred propanediol is 2-amino-2-ethyl-1,3-propanediol.

Preferred friction modifying components for the lubricating oil of the invention are those where R is lauryl or oleyl. These are effective in a range from about 0.1 to 5 weight percent based on the total lubricating oil composition. However, it is preferred to employ from about 0.5 to 2 weight percent of the derivative based on the weight of the lubricating oil with the most preferred concentration ranging from about 0.75 to 1.5 weight percent.

The following examples illustrate the best mode of making and using the friction reducing additive component of the cylinder oil composition of the invention.

EXAMPLE I

Synthesis of Oxazoline of Sarkosyl O

A mixture of 0.7 mole of oleyl sarcosine and 0.7 mole of 2 amino-2-ethyl 1,3 propanediol in 600 parts of xylene was refluxed & water of reaction was azeotroped over. After 8 hours of reflux, the reaction mixture was cooled and filtered, then stripped under vacuum. The residue was analyzed by I. R. and elemental analysis.

EXAMPLE II

A mixture of 0.7 mole of lauroyl sarcosine and 0.7 mole of 2-amino-2-ethyl,1,3 propanediol in 600 ml. of xylene was refluxed and water of reaction was azeotroped over. At the end of 8 hours, the reaction was stripped, filtered, and stripped under vacuum. The residue was analyzed by I. R. and elemental analysis.

EXAMPLE III

A mixture of 0.7 mole of cocoyl sarcosine and 0.7 mole of 2-amino-2-ethyl-1,3-propanediol is reacted as in Example I to give the oxazoline of cocoyl sarcosine.

EXAMPLE IV

A mixture of 0.7 mole of stearyl sarcosine and 0.7 mole of 2-amino-2-ethyl-1,3-propanediol is reacted as in Example I to give the oxazoline of stearyl sarcosine.

The hydrocarbon oil which can be employed to prepare the diesel lubricating oil composition of the invention includes naphthenic base, paraffinic base and mixed base mineral oils, lubricating oil derived from coal products and synthetic oils, e.g., alkylene polymers such as polypropylene and polyisobutylene of a molecular weight of between about 250 and 2500. Advantageously, a lubricating base oil having a lubricating oil viscosity SUS at 100° F. of between about 50 and 1500, preferably between 100 and 1200, are normally employed for the lubricant composition. The most preferred lubricating viscosity for a crankcase lubricating oil composition is a viscosity ranging from about 56 to 68 SUS at 210° F. The hydrocarbon oil will generally constitute from about 80 to 90 weight percent of the total lubricating oil composition with the preferred concentration range being from about 82 to about 88 weight percent.

The improvement in fuel economy brought about by the novel crankcase lubricant composition of the invention was demonstrated in the Small Engine Friction Test. The Small Engine Friction Test (SEFT) uses a single cylinder, air-cooled, 6-horsepower engine driven by an electric motor. The engine has a cast-iron block and is fitted with an aluminum piston and chrome-plated rings. The electric motor is cradle-mounted so that the reaction torque can be measured by a strain arm. The engine is housed in a thermally insulated enclosure with an electric heater and is driven at 2000 rpm.

Prior to each test, the engine is flushed three times with 1-quart charges of test oil. During the test run, the engine and oil temperatures are increased continually from ambient until a 280° F. oil temperature is reached. The heat comes from engine friction, air compression work and from the electric heater. The engine and oil temperatures and the engine motoring torque are recorded continually during the test. A SEFT run takes about 4 hours. Each test oil evaluation is preceded by a run on a reference oil for a like period of time. The torque reference level for the engine shifts very slowing with time as a result of engine wear. Therefore, the test oil results were recorded compared to a reference band consisting of data from up to three reference runs made before and three runs made after the test oil evaluation.

The frictional effects of the novel lubricating oil composition of the invention containing the prescribed oxazoline friction modifier was evaluated in a commercial marine diesel lubricating oil composition. The commercial lubricant or base oil and the modified oil containing the friction modifier of the invention were tested for their friction properties in the Small Engine Friction Test described above.

The following example of Table I illustrates the effectiveness of the additive of the invention in a 6 TBN marine crankcase oil composition.

TABLE I

SMALL ENGINE FRICTION TEST ON TBN CRANKCASE OIL

| | Crankcase Oil (Base Oil) | Modified Crankcase Oil A |
|---|---|---|
| Composition, Wt. % | | |
| Solvent Neutral Oil VIS at 100° F. of 325-350 SUS | 10.0 | 10.0 |
| Solvent Neutral Oil Vis SUS at 100° F. of 335 SUS | 33.73 | 32.73 |
| Pale Oil Vis SUS at 100° F. = 425 | 43.00 | 43.00 |
| Antiwear, Antioxidant (1) | 0.84 | 0.84 |
| Detergent, dispersant (2) | 3.92 | 3.92 |
| Dispersant additive (3) | 2.03 | 2.03 |
| Detergent (4) | 4.65 | 4.65 |
| Detergent (5) | 1.83 | 1.83 |
| Antifoam Agent (6) | 150 ppm | 150 ppm |
| Additive of Example 1 | — | 1.00 |

(1) Zinc dialkyldithiophosphate
(2) Monohydroxyethyl alkene thiophosphonate
(3) Alkenyl succinic anhydride, 8%
N—polyamine-C—alkenylsuccinimide 19%, zinc salt of alkenylsuccinic acid 28%, mineral oil 42%
(4) Overbased sulferized calcium phenate (OLOA 218A) which has a nominal TBN of 197.
(5) Overbased calcium sulfonate nominal TBN of about 400.
(6) Dimethyl silicone.

TABLE II

SMALL ENGINE FRICTION TEST

| | Crankcase Oil (Base Oil) | Modified Crankcase Oil (Oil A) |
|---|---|---|
| Engine Motor Torque, Foot Lbs. at 280° C. | 2.82 | 2.46 |
| Decrease in Torque ft.-lbs. | — | 0.425 |
| Decrease in Torque, % | — | 12.8 |

The foregoing examples demonstrate the effectiveness of the acyl glycine oxazoline as surprisingly effective as a friction modifier for reducing engine motor torque in the prescribed crankcase oil composition of the invention. Significant fuel economies are realized from the use of the prescribed lubricating oil composition of the invention.

We claim:

1. A crankcase lubricating oil composition having a Total Base Number in the range from about 5 to 40 comprising a major proportion of a mineral lubricating oil containing from about 0.1 to 5 weight percent of at least one overbased calcium sulfonate, from about 0.1 to 1 weight percent of a zinc dithiophosphate represented by the formula:

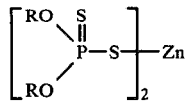

in which R is a hydrocarbyl radical or a hydroxy substituted hydrocarbyl radical having from 4 to 12 carbon atoms from about 0.5 to 10 weight percent of nitrogen-containing dispersant represented by the formula:

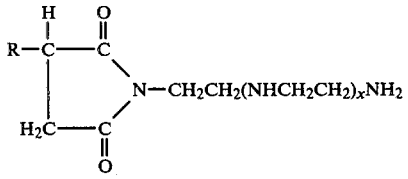

where R is alkenyl of from 50 to 200 carbons and x is an integer of 0 to 10, from 0.1 to 5 weight percent of an overbased calcium sulfonate sufficient to impart to the composition a Total Base Number of between about 5 and 40; between about 0.3 and 10 weight percent of an ethoxylated inorganic phosphorus acid free steam hydrolyzed $NO_2$-blown polybutene (800–2500 MW) $P_2S_5$ reaction product, from about 0.1 and 7.00 weight percent of an overbased sulfurized calcium phenolate and a minor friction reducing amount of at least one acyl glycine oxazoline of the formula:

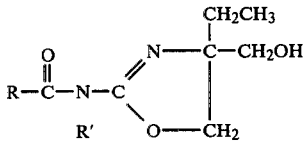

where R is lauryl, $C_{11}H_{23}$, oleyl or stearyl; R′ is hydrogen or (lower) alkyl.

2. A lubricating oil composition according to claim 1 in which said overbased calcium sulfonate is derived from petroleum sulfonic acids or alkylated benzene sulfonic acids having from 12 to 200 carbon atoms.

3. A lubricating oil composition according to claim 1 containing from about 0.5 to 2 weight percent based on said lubricating oil composition of said N-acyl glycine derivative.

4. A lubricating oil composition according to claim 1 containing in which the concentration of said N-acyl glycine derivative ranges from about 0.75 to 1.5 weight percent.

5. A lubricating oil composition according to claim 1 characterized by having a TBN ranging from about 15 to 30.

6. A lubricating composition according to claim 1 wherein said polybutene-$P_2S_5$ product is monohydroxyethyl alkene thiophosphonate.

7. A lubricating composition according to claim 1 containing also an antifoam agent.

* * * * *